United States Patent [19]

Kato

[11] 4,419,551

[45] Dec. 6, 1983

[54] VACUUM CIRCUIT INTERRUPTER AND METHOD OF PRODUCING THE SAME

[75] Inventor: Masaru Kato, Amagasaki, Japan

[73] Assignee: Mitsubishi Denki Kabushiki Kaisha, Japan

[21] Appl. No.: 192,842

[22] Filed: Oct. 1, 1980

Related U.S. Application Data

[63] Continuation of Ser. No. 910,905, May 26, 1978, abandoned.

[30] Foreign Application Priority Data

May 27, 1977 [JP] Japan ..... 52-62356
May 27, 1977 [JP] Japan ..... 52-62359

[51] Int. Cl.[3] ..... H01H 33/66
[52] U.S. Cl. ..... 200/144 B
[58] Field of Search ..... 75/200, 206, 222, 224, 75/; 200/144 B, 264, 265, 266

[56] References Cited

U.S. PATENT DOCUMENTS 3,357,826 12/1967 Honaker ..... 75/222 X
3,535,110 10/1970 Todd ..... 75/222 X
3,700,435 10/1972 Chandhok ..... 75/223 X
3,818,163 6/1974 Robinson ..... 200/264 X
3,821,505 6/1974 Wood ..... 200/144 B
3,863,337 2/1975 Schreiner et al. ..... 200/264 X
4,032,301 6/1977 Hassler et al. ..... 200/264 X

FOREIGN PATENT DOCUMENTS 49-8614 2/1974 Japan .
1194674 6/1970 United Kingdom .
1255685 12/1970 United Kingdom .

*Primary Examiner*—J. R. Scott
*Attorney, Agent, or Firm*—Wenderoth, Lind & Ponack

[57] ABSTRACT

An improved vacuum circuit interrupter, the electrode contacts of which are formed from a sintered copper-chromium alloy, with chromium dispersed in a copper matrix.

The chromium particles having a mean particle size of not more than 100 μm, the copper particles having a mean particle size of not less than 5 μm, the electrode contacts have a density of not less than 90% relative to the theoretical density thereof, the copper is present at 80 to 20 wt. % and the chromium is present at 20 to 80 wt. %.

3 Claims, 9 Drawing Figures

ELECT. COND. IN %
100
80
60
40
20
20
40
60
80
Cu CONT. IN WT. %

CONTACT RES. IN μΩ
100
80
60
40
20
20
40
60
80
Cu CONT. IN WT. %

SUR. HARDNESS IN HRF
160
120
80
40
20
40
60
80
Cu CONT. IN WT. %

DIELEC. STR. IN KV
50
40
30
20
10
20
40
60
80
Cu CONT. IN WT. %

CHOP. CUR. IN A
8
6
4
2
20
40
60
80
Cu CONT. IN WT. %

WELD. RES. IN KA
20
16
12
8
4
b
a
20
40
60
80
Cu CONT. IN WT. %

VACUUM CIRCUIT INTERRUPTER AND METHOD OF PRODUCING THE SAME

This is a continuation of Ser. No. 910,905 filed May 26, 1978, now abandoned.

BACKGROUND OF THE INVENTION

This invention relates to a vacuum circuit interrupter including a pair of electrode contacts having high dielectric strength.

In vacuum circuit interrupters required to have the ability to interrupt high currents, the electrode contact has been previously of an alloy of copper and bismuth. It is said that the use of copper-bismuth system alloys is advantageous in that the resulting electrode contact has a welding resistance controlled to a sufficiently small magnitude that its dielectric strength is not much decreased. However, bismuth included in the electrode contact has contributed to a main cause for decreasing the dielectric strength and therefore has resulted in a great disadvantage.

Accordingly, it is an object of the present invention to provide a new and improved vacuum circuit interrupter having an excellent interrupting ability.

It is another object of the present invention to provide a new and improved vacuum circuit interrupter increased in dielectric strength.

It is still another object of the present invention to provide a new and improved vacuum circuit interrupter having a low contact resistance developed between electrode contacts involved.

SUMMARY OF THE INVENTION

According to one aspect thereof, the present invention provides a vacuum circuit interrupter comprising a pair of electrode contact engaging and disengaging from each other, each of the electrode contacts consisting of copper and chromium and sintered together in the solid phase, whereby said chromium particles are uniformly dispersed amongst said copper particles;

said chromium particles having a mean particle size of not more than 100 μm;

said copper particles having a means particle size of not less than 5 μm;

said electrode contacts having a density of not less than 90% relative to the theoretical density thereof and said copper being present at 80 to 20 wt. % and said chromium being present at 20 to 80 wt. %.

BRIEF DESCRIPTION OF THE DRAWINGS

The present invention will become more readily apparent from the following detailed description taken in conjunction with the accompanying drawings in which.

DESCRIPTION OF THE PREFERRED EMBODIMENTS

Figure 1:
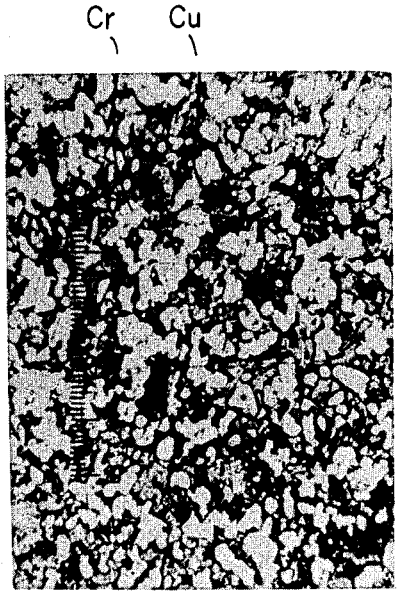
FIG. 1 is a photomicrograph illustrating an aggregate structure of an electrode contact of copper-chronium system alloy constructed in accordance with the principles of the present invention.

Generally, electrode contacts for vacuum circuit interrupters are required to have the following characteristics:

(1) High interrupting ability
(2) High dielectric strength
(3) Low contact resistance
(4) Low welding power
(5) Low chopping current characteristics etc.

It is extremely difficult to impart all the above-mentioned characteristics to electrode contacts for vacuum circuit interrupters and it is a common practice to produce electrode contacts to fulfill more important of those characteristics dependent upon the particular application, with the remaining characteristics inevitably sacrificed more or less.

The present invention contemplates production of contact materials particularly excellent in the characteristics (1), (2) and (3) as above described for the purpose of forming the electrode contact for vacuum circuit interrupters used with electric circuits high in voltage and large in current capacity.

It has been noticed that chromium (Cr) has a high dielectric strength in vacuum but the chromium can not exhibit a high interrupting ability by itself because it is heat resistive and therefore high in thermoionic emission. Further, the chromium is low in electric conductivity and high in contact restance, and it has been found that if vacuum circuit interrupters with the high current capacity are provided with chromium electrode contacts, the same can not be employed due to their temperature rise and the like.

The present invention provides vacuum circuit interrupters attaining the desired objects as above described by eliminating the above-mentioned disadvantages of chromium while making effective use of the advantages thereof as above described.

In order to eliminate the disadvantages of the chromium, copper (Cu) is added to chromium to form a copper-chromium alloy. If copper-chromium alloys are formed according to casting technique as in the prior art practice, then the chromium is unevenly dispersed in the copper matrix. In order to avoid this objection, the powder metallurgical technique is employed to form copper-chromium alloys. This permits the easy formation of copper-chromium alloys including chromium uniformly dispersed in the copper matrix.

Upon practicing the present invention, it is required that copper particles have a mean particle size of 5 μm or more chromium particles have a mean particle size of 100 μm or less, to attain a satisfactory result. As compared with the mean copper particle size on the order of 3 μm, the use of a mean copper particle size of at least 5 μm causes a decrease in hydrogen loss of the resulting alloy and and also decreases in content of low boiling-point impurities included in the alloy. It has been found that electrode contacts including copper particles with a mean particle size of at least 5 μm are excellent in handling high currents at high voltages.

Also, upon producing a contact material according to powder metallurgical technique, it is required to prevent fine powders of starting metals from adversely affecting the human body etc. In this respect copper particles having a mean particle size of not less than 5 μm are advantageously used because such copper particles are difficult to float or drift and disperse as compared with those having a mean particle size on the order of 3 μm.

As above-described, the present invention takes advantage of the electrical property of chromium that its dielectric strength is high in vacuum. This results in the necessity of uniformly dispersing chromium into the copper matrix. From this viewpoint, it is desirable that chromium particles have a mean particle size as small as possible. In order to determine the upper limit as to the mean particle size of chromium particles, experiments have been conducted with respect to the dielectric strength and interrupting ability. The results of the experiments have indicated that the mean particle size of the chromium particles is sufficient if not greater than 100 μm.

On the other hand, chromium is very easily oxidized. In order to avoid this oxidation of chromium, the present invention sinters a mixture of copper and chromium particles having mean particle sizes as above-described in a non-oxidizing atmosphere including any of vacuum, hydrogen and inert gas such as neon, argon etc. By sintering the copper-chromium mixture particularly in a high vacuum or in an atmosphere having a highly reducing power, the chromium is fully prevented from oxidizing.

If copper-chromium electrode contacts are formed by using copper particles having a mean particle size on the order of 3 μm, this results in objections such as hydrogen loss, oxygen content or contents of low melting-point impurities etc. In order to eliminate these objections, the electrode contacts may be formed in a vacuum furnace at an elevated temperature thereby to dissociate and remove oxides contained in the contact material and scatter low melting-point impurities included therein. However, the use of a vacuum furnace has resulted in high cost and therefore in expensive electrode contacts because the furnace is operated while being kept in a high vacuum. Thereby, the vacuum furnace is lowered in operating efficiency and the interior thereof has been difficult to be uniformly heated.

Electrode contacts were experimentally formed by sintering a mixture of copper particles having a mean particle size on the order of 3 μm in an atmosphere of hydrogen. The results of experiments have indicated that objections also appear in both oxygen content and contents of low melting-point impurities. By using copper particles with mean particle size of not smaller than 5 μm, good copper-chromium alloys have been able to be formed in an atmosphere of hydrogen. Even for the mean copper particle size of 3 μm, the sintering in a vacuum has exhibited a good result in view of the contents of oxygen and low melting-point impurities. However this procedure has resulted in expensive electrode contacts as above described.

From the foregoing it is seen that, by rendering the mean particle size of copper equal to not less than 5 μm, the sintering in a non-oxidizing atmosphere such as hydrogen is not objectionable in view of contents of oxygen and low melting-point impurities. Therefore the particular sintering furnace becomes high in operating efficiency and can manufacture electrode contacts at low cost.

The present invention will now be described in more detail in conjunction with preferred embodiments thereof. First, copper particles having a mean particle size of not smaller than 5 μm are uniformly mixed with chromium particles having a mean particle size of not greater than 100 μm in different proportions, to form Cu-Cr mixtures which are, in turn, shaped into predetermined pellets.

The pellets thus shaped are sintered in at atmosphere of hydrogen having a dew point on the order of −20° C. Before this sintering, low melting-point metals included in minute amounts, as impurities, in the copper and/or chromium particles, may be preliminarily heated in a vacuum at an elevated temperature to be removed from the particles. This measure improves the dielectric strength characteristic of the resulting electrode contacts.

In order to reduce and remove effectively oxides from the copper and chromium particles, it is required to lower sufficiently the dew point of the hydrogen. It has been experimentally found that an oxygen content in an atmosphere of hydrogen can be controlled to not greater than 3,500 ppm by weight with its dew point on the order of −20° C. and that electrode contacts processed in an atmosphere of hydrogen have their performances necessary and sufficient for use with vacuum circuit interrupters as far as it includes oxygen in an amount of at most 3,500 ppm by weight. Further the results of heavy duty tests have proved that those electrode contacts have lifetimes in vacuum equal to from 30 to 50 years.

Also it is desirable that the electrode contact for vacuum circuit interrupters have a high density ratio relative to its theoretical density. It has been found, that, with a density ratio not less than 90%, the Cu-Cr system electrode contacts as above described are enabled to interrupt currents having magnitudes of scores of kiloamperes at several tens of kilovolts, and that an amount of consumption due to the opening and closure of direct currents is so small that it is out of the question.

Also, a mixture of finely divided copper and chromium particles may be sintered in an atmosphere of hydrogen either in the solid phase, that is, at a temperature at which the copper particles are not melted or in the liquid phase, that is, at a temperature at which the copper particles are melted. In the former case, it has been found that oxides included in the copper and chromium particles can be effectively reduced and removed therefrom as a result of the hydrogen penetrating the interior of the mixture. In the latter case, the resulting electrode contacts have reached the required density within a time interval shorter than that required for the sintering in the solid phase.

Referring now to FIG. 1 of the drawing, there is shown a photomicrograph, illustrating an aggregate structure of an electrode contact including 75% by weight of copper and 25% by weight of chromium and constructed in accordance with the principles of the present invention. The photomicrograph is magnified by four hundred times and shows chromium particles uniformly dispersed among copper particles.

Figure 2:
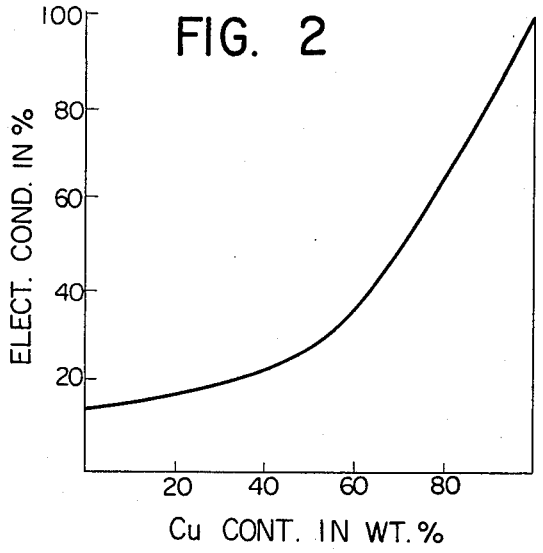
FIG. 2 is a graph illustrating the relationship between a percentage electric conductivity and percentage copper content (wt. %) of a copper-chromium system electrode contact.

FIG. 2 is a graph illustrating the percentage electric conductivity plotted as an ordinate against the copper content in percent as an abscissa for electrode contacts constructed as above described. The percentage electric conductivity is shown as a percentage of an electric conductivity of unity which pure copper is assumed to have the value of. From FIG. 2 it is seen that the electric conductivity is increased with the copper content.

The following FIGS. 3 through 9 depict similar electrode contacts just described.

Figure 3:
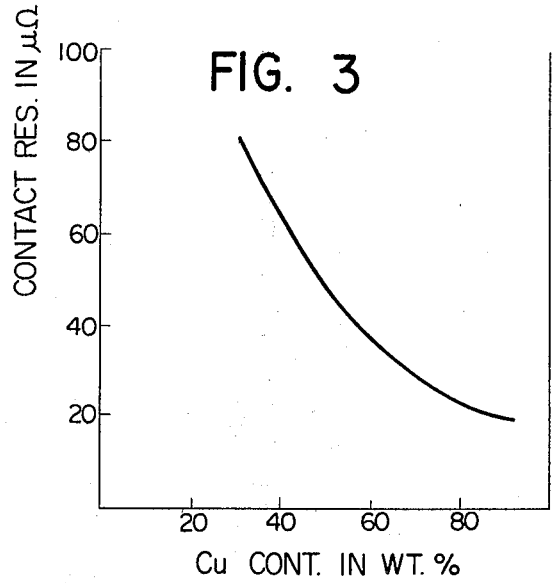
FIG. 3 is a graph illustrating the relationship between contact resistance and percentage copper content (wt. %) of a copper-chronium system electrode contact.
Figure 4:
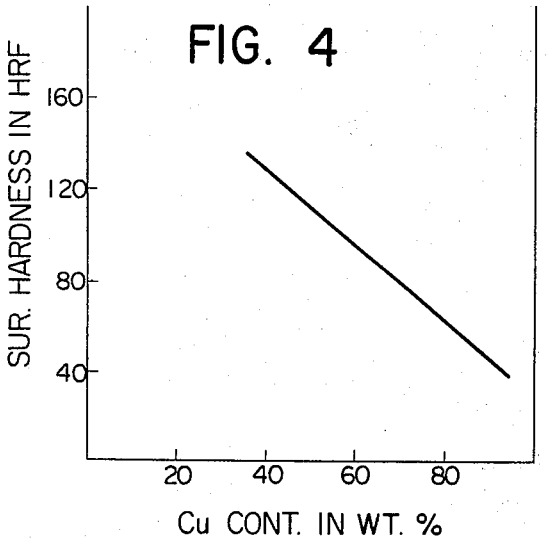
FIG. 4 is a graph illustrating the relationship between a surface hardness and percentage copper content (wt. %) of a copper-chromium system electrode contact.

FIG. 3 is a graph illustrating contact resistance in microohms plotted as an ordinate against copper content in percent as an abscissa and FIG. 4 is a graph illustrating a surface hardness as an HRF plotted in ordinate against a copper content in percent as in abscissa. As shown in FIGS. 3 and 4, both the contact resistance and surface hardness are decreased as the copper content increases.

The illustration of FIG. 3 can be interpreted as teaching that an increase in copper content causes an increase in electric conductivity and also a decrease in surface hardness attended with an increase in effective contact area which, in turn cooperates in multiplying relationship with the increase in electric conductivity to decrease the contact resistance.

In FIG. 3 it is noted that the contact resistance is increased to a high value with copper contents smaller than about 20%.

Figure 5:
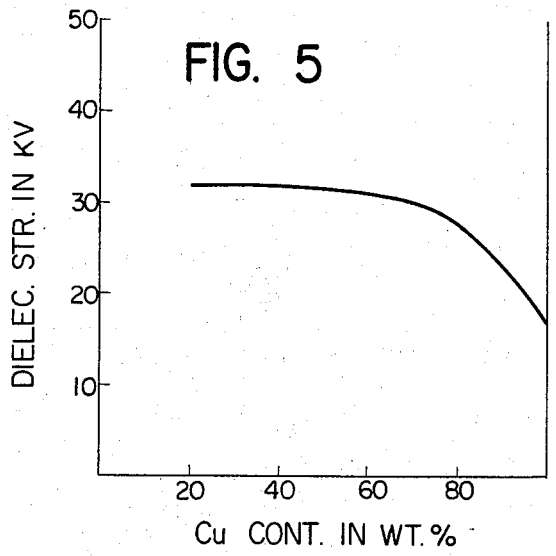
FIG. 5 is a graph illustrating the relationship between dielectric strength and percentage copper content (wt. %) of a copper-chromium system electrode contact.

In FIG. 5 the abscissa represents a copper content in percent and the ordinate represents dielectric strength in kilovolts. The curve depicts dielectric strength after a current of about 200 amperes has switched on and off fifty thousand times. From FIG. 5 it is seen that the dielectric strength slowly decreases with an increase in copper content and rapidly decreases with a copper content in excess of 80%.

Figure 6:
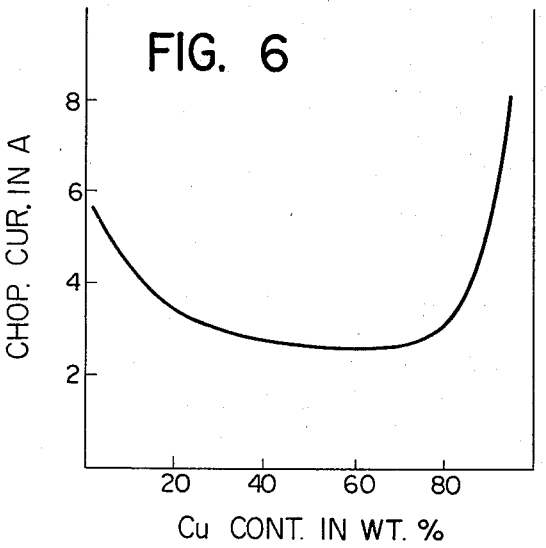
FIG. 6 is a graph illustrating the relationship between chopping current and a percentage copper content (wt. %) of a copper-chromium system electrode contact.

In FIG. 6 a chopping current in amperes is plotted in ordinate against a copper content in percent in abscissa. As shown, the chopping current is in the form of a generally U-shaped curve with respect to the copper content. In the example illustrated, the chopping current averages about 3.3 amperes or less, with the copper content ranging from 20% to 80% by weight and increases when the copper content is smaller than about 20% and greater than about 80%.

The electrode contact of the present invention has a chopping current characterized in that the mean value thereof is considerably low, the deviation of the measured value from the mean value is small and it is not much changed after the switching-on and -off of currents and so on as compared with copper-bismuth system electrode contact. In this connection it is noted that with electrode contacts formed of copper-bismuth alloys having the low melting-point metal added thereto, the chopping current is relatively much changed, dependent upon the number of interruptions of currents.

Figure 7:
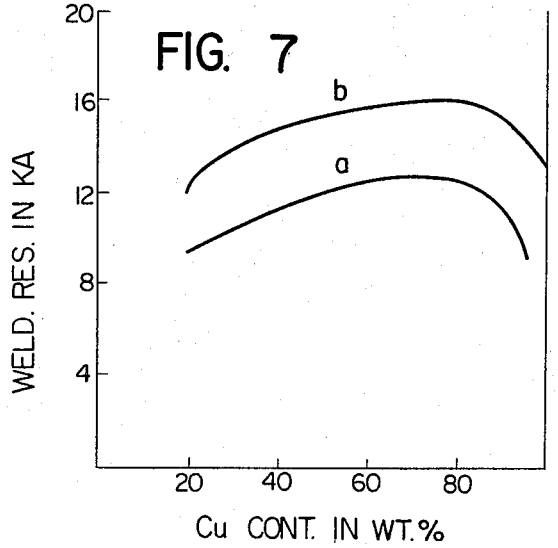
FIG. 7 is a graph illustrating the relationship between a welding resistance and a percentage copper content (wt. %) of a copper-chromium system electrode contact.

FIG. 7, wherein the abscissa represents copper content in percent and the ordinate represents a current in kiloamperes, illustrates the relationship between the welding characteristic and the copper content. A pair of copper-chromium system electrode contacts disposed within a model tube were put in engagement with each other while a pressure of 20 kilograms was applied to the electrode contacts. After a predetermined current had flowed through the electrode contacts, a maximum current was measured at which the electrode contacts could be separated from each other with a force of 100 kilograms. This measurement was repeated with various electrode contacts having different proportions of the copper to the chromium. The curve labelled a depicts a current with which the electrode contacts are not welded to each other while the curve labelled b depicts a current with which the electrode contacts have been welded to each other.

From FIG. 7 it is seen that, the measured current a or b increases as the copper content increases up to about 80% but decreases when the copper contant exceeds about 80%.

From the illustration of FIGS. 2 through 7 it has been determined that the electrode contact of the present invention should include from 80 to 20% by weight of copper and from 20 to 80% by weight of chromium, with minute amounts of impurities.

Figure 8:
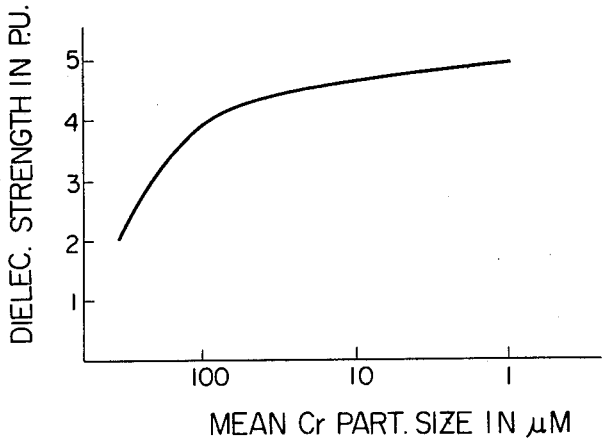
FIG. 8 is a graph illustrating the relationship between dielectric strength and the mean chromium particle size of a copper-chromium system electrode contact.

FIG. 8 shows the relationship between a dielectric strength and a particle size of chromium particles. In FIG. 8 the abscissa represents the mean particle size in μm of chromium particles and the ordinate represents the dielectric strength in P.U.

From FIG. 8 it is seen that the dielectric strength is maintained substantially constant as far as the chromium particles have the mean particle size of not smaller than 100 μm.

Figure 9:
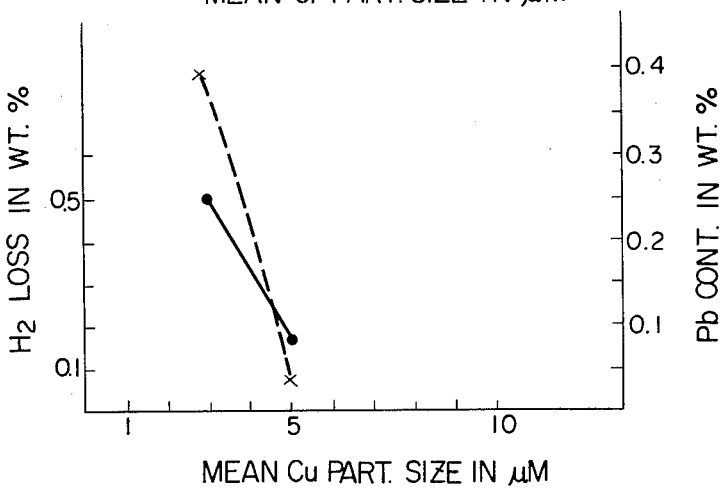
FIG. 9 is a graph illustrating a hydrogen loss and a percentage lead content (wt. %) plotted against the mean copper particle size for a copper-chromium system electrode contact.

In FIG. 9, a hydrogen loss in percent and a lead (Pb) content in percent are plotted as an ordinate against the mean particle size of copper particles in μm as an abscissa. The solid curve describes the hydrogen loss while broken line describes the lead content. As seen in FIG. 9, the mean particle size on the order of 5 μm decreases a hydrogen loss to 50% or less of that occurring with the mean particle size on the order of 3 μm. Also when the meam particle size changes from 3 to 5 μm, the lead content decreases to 10% or less of that obtained with 3 μm.

By considering the results shown in FIGS. 8 and 9, the chromium and copper particles for use with the present invention have been determined to have the mean particle sizes of not greater than 100 μm and not smaller than 5 μm respectively.

In addition, it has been experimentally found that the electrode contact of present invention has the excellent characteristics concerning an arc time upon interrupting a current having a root mean square value of 40 kiloamperes although this is not illustrated graphically.

What is claimed is:

1. A vacuum circuit interrupter comprising a pair of electrode contacts engagable and disengagable from each other, each of said electrode contacts consisting of an aggregate structure formed by sintering copper particles and chromium particles together in the solid phase, whereby said chromium particles are uniformly dispersed amongst said copper particles:

said chromium particles having a mean particle size of not more than 100 μm;

said copper particles having a mean particle size of not less than 5 μm;

said electrode contacts having a density of not less than 90% relative to the theoretical density thereof and said copper being present at 80 to 20 wt. % and said chromium being present at 20 to 80 wt. %.

2. The vacuum circuit interrupter of claim 1 wherein the copper is present at from 75 to 80% by weight.

3. The vacuum circuit interrupter of claim 2 wherein copper is present at 75% by weight and chromium at 25% by weight.

* * * * *